US008575466B2

(12) United States Patent
van Ekstrom

(10) Patent No.: US 8,575,466 B2
(45) Date of Patent: Nov. 5, 2013

(54) BALL PLUNGER-STYLE CONNECTOR ASSEMBLY FOR ELECTRICAL CONNECTIONS

(76) Inventor: Gordon van Ekstrom, Kirkland, WA (US)

( * ) Notice: Subject to any disclaimer, the term of this patent is extended or adjusted under 35 U.S.C. 154(b) by 651 days.

(21) Appl. No.: 12/843,107

(22) Filed: Jul. 26, 2010

(65) Prior Publication Data

US 2010/0330817 A1 Dec. 30, 2010

Related U.S. Application Data

(63) Continuation-in-part of application No. 12/508,493, filed on Jul. 23, 2009, now Pat. No. 7,838,758, which is a continuation-in-part of application No. 11/612,780, filed on Dec. 19, 2006, now abandoned.

(51) Int. Cl.
*G10H 1/32* (2006.01)
*G10H 3/00* (2006.01)

(52) U.S. Cl.
USPC ..... 84/743

(58) Field of Classification Search
USPC ..... 84/290, 291, 267, 726, 743
See application file for complete search history.

(56) References Cited

U.S. PATENT DOCUMENTS

| | | | | |
|---|---|---|---|---|
| 4,334,452 | A | 6/1982 | Morrison et al. | |
| 4,425,831 | A * | 1/1984 | Lipman | 84/743 |
| 4,433,603 | A * | 2/1984 | Siminoff | 84/726 |
| 4,854,210 | A | 8/1989 | Palazzolo | |
| 4,872,386 | A | 10/1989 | Betticare | |
| 5,029,511 | A | 7/1991 | Rosendahl | |
| 5,235,891 | A * | 8/1993 | Klein | 84/291 |
| 5,252,777 | A * | 10/1993 | Allen | 84/726 |
| 5,335,576 | A | 8/1994 | Hayashi | |
| 5,637,823 | A * | 6/1997 | Dodge | 84/743 |
| 5,736,702 | A * | 4/1998 | Roberts et al. | 200/81 H |
| 5,767,432 | A | 6/1998 | Randolph | |
| 5,899,753 | A * | 5/1999 | Wong et al. | 439/17 |
| 5,929,362 | A | 7/1999 | Oteyza | |
| 6,043,422 | A * | 3/2000 | Chapman | 84/723 |

(Continued)

FOREIGN PATENT DOCUMENTS

| | | |
|---|---|---|
| EP | 0678852 | 10/1995 |
| JP | 2004-163717 | 6/2004 |

*Primary Examiner* — Jeffrey Donels

(57) ABSTRACT

A ball plunger-style lateral connector assembly for electrical connections, comprising an electrically conductive connector body with an electrically conductive pin positioned in an aperture in a closed end of the body. A first end portion of the pin member extends at least partially into the interior area of the connector body. An electrically conductive connector plate is adjacent to the closed end of the connector body and engages the first end portion of the pin member and provides an electrical connection therebetween. An insulator sleeve may be disposed in the interior area of the connector body and adjacent to the sidewall of the connector body. An electrically conductive biasing member is disposed in the interior area of the connector body. The biasing member has a first end portion in engagement with the connector plate, and wherein the insulator sleeve is disposed between the biasing member and the connector body. An electrically conductive ball track is positioned within the interior area of the connector body and is in engagement with a second end portion of the biasing member. An electrically conductive ball is disposed in the open end portion of the connector body and is seated in the concave seating portion of the ball track. The ball is configured to roll within ball track during use of the lateral connector.

21 Claims, 6 Drawing Sheets

(56) References Cited

U.S. PATENT DOCUMENTS

| | | | | |
|---|---|---|---|---|
| 6,111,184 | A * | 8/2000 | Cloud et al. | 84/723 |
| 6,253,654 | B1 * | 7/2001 | Mercurio | 84/267 |
| 6,331,091 | B2 * | 12/2001 | Cross | 403/322.2 |
| 6,781,050 | B2 | 8/2004 | Olvera et al. | |
| 7,183,194 | B2 * | 2/2007 | Farnworth | 438/621 |
| 7,256,343 | B2 | 8/2007 | Brubaker et al. | |
| 7,442,865 | B2 | 10/2008 | Moghaddam | |
| 7,453,033 | B2 | 11/2008 | Redard | |
| 7,459,624 | B2 * | 12/2008 | Schmidt et al. | 84/477 R |
| 7,538,269 | B2 | 5/2009 | van Ekstrom | |
| 7,635,809 | B2 | 12/2009 | Higgs et al. | |
| 7,737,349 | B1 * | 6/2010 | Spurgeon et al. | 84/291 |
| 7,838,758 | B2 * | 11/2010 | Van Ekstrom | 84/743 |
| 2003/0164080 | A1 * | 9/2003 | Childress | 84/291 |
| 2007/0037418 | A1 * | 2/2007 | Akram et al. | 439/82 |
| 2008/0105101 | A1 * | 5/2008 | Eldring | 84/291 |
| 2008/0141841 | A1 * | 6/2008 | Van Ekstrom | 84/291 |
| 2008/0141851 | A1 * | 6/2008 | Ekstrom | 84/726 |
| 2009/0082078 | A1 * | 3/2009 | Schmidt et al. | 463/7 |
| 2009/0088250 | A1 * | 4/2009 | Carlson et al. | 463/37 |
| 2009/0183626 | A1 | 7/2009 | Salehi | |
| 2010/0031800 | A1 * | 2/2010 | Ekstrom | 84/291 |

* cited by examiner

BALL PLUNGER-STYLE CONNECTOR ASSEMBLY FOR ELECTRICAL CONNECTIONS

CROSS-REFERENCE TO RELATED APPLICATIONS

This application is a continuation-in-part of U.S. patent application Ser. No. 12/508,493, titled "Docking System For Pickups On Electric Guitars", filed Jul. 23, 2009 now U.S. Pat. No. 7,838,758, which is a continuation-in-part application of U.S. patent application Ser. No. 11/612,780, titled "Docking System For Pickups On Electric Guitars", filed Dec. 19, 2006 now abandoned.

TECHNICAL FIELD

Embodiments of the present invention are directed to electro-mechanical connectors.

BACKGROUND

Ball plungers have been used and mechanical detents in a variety of applications. Ball plungers are often used as a mechanical detent between two components that move laterally relative to each other between engaged and disengaged positions. Often times it is highly desirable to provide an electrical connection between to such components that move laterally relative to each other. There is a need for an improved ball plunger assembly that provides electrical connection between such components.

A ball plunger assembly has been used to provide mechanical and electrical interconnections between laterally disposable components of a docking system for pickups on electric guitars. As an example, Applicant's issued U.S. Pat. No. 7,538,269, issued May 26, 2009, titled "Docking System For Pickups On Electric Guitars," and co-pending U.S. patent application Ser. No. 12/508,493 (Publication No. 2010-0031800), filed Jul. 23, 2009, titled "Docking System For Pickups On Electric Guitars," both of which are hereby incorporated in their entireties by reference thereto, generally disclose a ball plunger assembly that acts as an electrical connector.

Testing of the electrical properties of these conventional ball plunger assemblies, however, confirmed that the conventional ball plungers could work to provide electrical and mechanical connections, but the ball plungers required improvement to achieve a reliable performance level required for a high quality electric instrument, such as the electric guitar or other musical instrument. Even the most promising samples of the conventional ball plunger assemblies containing all metal materials, such as 440 stainless steel balls, music wire spring material, and 303 stainless steel bodies (all conductive materials) produced unacceptably erratic and/or inconsistent resistance and conductance results.

While the conventional ball plungers provided for superior mechanical engagement for use in applications requiring lateral engagements, all of the conventional ball plungers that were electrically tested could not achieve the electrical performance requirements for use as a reliable, safe current carrier device. For example, conventional ball plungers have unacceptably erratic and unpredictable electrical resistance and conductance. Accordingly, the conventional ball plungers would be unacceptable and/or provide unreliable performance if used within electrical applications requiring superior reliability and performance. Therefore, the inventor has recognized performance limitations in the ball plunger assemblies and the need for substantial improvements in the ball plunger technologies.

SUMMARY

The present invention provides a ball plunger-style electrical connector assembly that overcomes drawbacks experienced in the prior art and that provide additional benefits. In an embodiment, the ball plunger-style electrical connector includes a body, an electrically conductive pin connected to the body and connectable to a wire or other electricity means, an electrically conductive connector plate within the body, an electrically conductive biasing member within the body, an electrically conductive ball track within the body and an electrically conductive ball partially disposed within the body and carried by the ball track. The connector assembly provides an improved electro-mechanical connector for use, as an example, as a lateral connector.

DETAILED DESCRIPTION

Figure 1A:
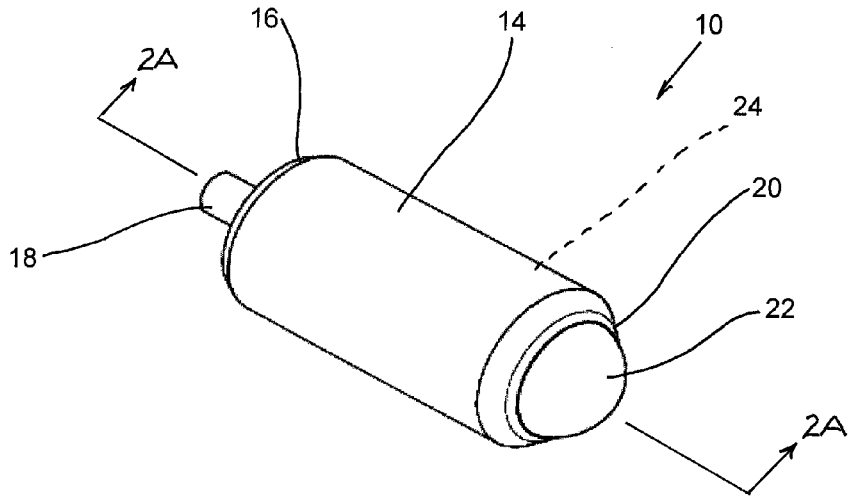
FIG. 1A is a front isometric view of a ball plunger-style electrical lateral connector accordance with an embodiment of the present invention.

The present disclosure describes a ball plunger-style electrical connector assembly in accordance with certain embodiments of the present invention. Several specific details of the invention are set forth in the following description and the Figures to provide a thorough understanding of certain embodiments of the invention. One skilled in the art, however, will understand that the present invention may have additional embodiments, and that other embodiments of the invention may be practiced without several of the specific features described below.

Embodiments of the present inventions include the ball plunger-style lateral connector for electrical connections on an installation assembly that slides or translates laterally relative to a mounting body between engaged and disengaged positions. The lateral connector is configured to provide electrical connection between electronic components on the installation and electronic components on the mounting body upon lateral translation to the installed position. Accordingly, the lateral connector can, as an example, provide for laterally actuated electrical male/female type connectors that complete a circuit between the electronic components. In addition, the lateral connector simultaneously acts as a mechanical retention device to removeably retain the installation assembly in the engaged position on the mounting body.

Some embodiments of the lateral connector are particularly well suited for use with high impedance, low voltage, low current devices. For example, an embodiment of the lateral connector can be incorporated in an improved docking system for pickups on electric guitars or other electric musical instruments. In such an embodiment, the lateral connector is configured to simultaneously provide electrical and mechanical connections upon lateral activation of, as an example, male/female type connectors without introducing additional mechanisms or interfering with or deviating from a natural interaction with the original instrument architecture or 'bloodline' of the instrument.

In an embodiment, a lateral connector assembly for electrical connections comprises an electrically conductive pin member operatively couplable to an electricity source. The pin member has first and second end portions. A connector body has an interior area, a closed end, an open end, and a sidewall extending between the closed and open ends. The closed end has an aperture with the pin member therein, and the first end portion of the pin member extends at least partially into the interior area of the connector body. A connector plate is in the interior area of the connector body and is positioned adjacent to the closed end of the connector body. The connector plate is electrically conductive and engages the first end portion of the pin member and provides an electrical connection therebetween. An insulator sleeve is disposed in the interior area of the connector body and adjacent to the sidewall of the connector body. An electrically conductive biasing member is disposed in the interior area of the connector body. The biasing member has a first end portion in engagement with the connector plate, and wherein the insulator sleeve is disposed between the biasing member and the connector body.

An electrically conductive ball track is positioned within the interior area of the connector body and is in engagement with a second end portion of the biasing member. The ball track has a concave seating portion that faces toward the open end of the connector body and that defines a rolling surface. An electrically conductive ball is disposed in the open end portion of the connector body and is seated in the concave seating portion of the ball track. The ball and ball track are configured to allow the ball to roll relative to connector body while maintaining engagement with the rolling surface of the ball track. The biasing member urges the ball track into engagement with the ball. The open end of the connector body is sized to retain the ball at least partially within the interior area. The ball is moveable with the ball track in the interior area toward the closed end of the connector body upon compression of the biasing member. The ball is configured to roll along a portion of the receiving member and to electrically engage the receiving contact portion while maintaining electrical contact with the ball track to achieve electrical interconnection between the pin member and the receiving member.

In another embodiment a lateral connector comprises an electrically conductive connection pin operatively couplable to an electricity source. A connector body has one end connected to the pin and an opposite open end. An electrically conductive connector plate is in the interior area of the connector body and is in engagement with an end portion of the pin. An electrically conductive biasing member is in the interior area of the connector body. The biasing member has a first end portion in engagement with the connector plate. An electrically conductive ball track is positioned within the interior area of the connector body and is in engagement with a second end portion of the biasing member. The ball track has a cup-shaped seating portion facing toward the open end of the connector body and defining a rolling surface. An electrically conductive ball is disposed in the open end portion of the connector body and is seated in the seating portion of the ball track with the ball track being between the ball and the biasing member. The ball and ball track are configured to allow the ball to roll relative to connector body while maintaining engagement with the rolling surface of the ball track. The biasing member urges the ball track into engagement with the ball, and the ball is moveable with the ball track into the interior area of the connector body upon compression of the biasing member.

In yet another embodiment, a ball plunger electrical connector is provided for engaging and completing electrical contact with a receiving member having an electrically conductive ball-receiving contact portion. The ball plunger electrical connector comprises an electrically conductive pin operatively couplable to an electricity source. The pin member has first and second end portions and is electrically conductive. The first end of the pin is threaded with first threads. A connector body has a closed end, an open end, and a sidewall extending between the closed and open ends, and an interior area. The closed end has a threaded aperture with second threads that mate with the first threads on the pin member. The pin member is screwed into the threaded aperture with at least a portion of the first end portion of the pin member extending from the closed end and at least partially into the interior area.

An electrically conductive connector plate is axially disposed in the interior area of the connector body and is positioned adjacent to the closed end of the connector body. The connector plate engages the first end portion of the pin member and provides an electrical connection therebetween. The connector plate has a partially concave shape with a concave portion facing toward the closed end of the connector body with the first end portion of the pin extending into the concave portion. An insulator sleeve is disposed in the interior area of the connector body and is adhered to an inner surface of the sidewall of the connector body. The insulator sleeve is configured to prevent electrical stray noise during use of the connector.

An electrically conductive beryllium copper coil spring is disposed in the interior area of the connector body. The spring has an interior space and a first end portion with a beveled flat portion that mates with a perimeter portion of the connector plate. The spring has a second end portion with a flattened engagement surface. An electrically conductive ball track is positioned within the interior area of the connector body and is in engagement with a second end portion of the biasing member. The ball track has a cup portion with a concave seating portion that faces toward the open end of the connector body and that defines a rolling surface. The ball track has a stem portion extending from the cup portion toward the closed end portion of the connector body. The cup portion defines an annular engaging shoulder adjacent to and extending radially outward from the stem portion. The flattened engagement surface of the second end portion of the spring is in constant engagement with the annular engaging shoulder. The stem portion is disposed with the interior space of the coil spring adjacent to the second end portion of the coil spring. The stem portion is sized to maintain a friction fit with the first end portion of the coil spring.

An electrically conductive ball is disposed in the open end portion of the connector body and is seated in the concave seating portion of the cup portion of the ball track. The ball and ball track are configured to allow the ball to roll relative to connector body while maintaining engagement with the rolling surface of the ball track. The spring urges the ball track into engagement with the ball. The ball has a first diameter, and the open end of the connector body defines a circular opening with a second diameter less than the first diameter. The open end portion of the connector body is sized to retain the ball at least partially within the interior area. The ball is moveable with the ball track in the interior area toward the closed end of the connector body upon compression of the spring. The ball is configured to roll along a portion of the receiving member and to electrically engage the receiving contact portion while maintaining electrical contact with the ball track when any portion of the ball is extending from the connector body to achieve electrical contact with the electrically conductive ball-receiving contact portion.

Figure 1B:
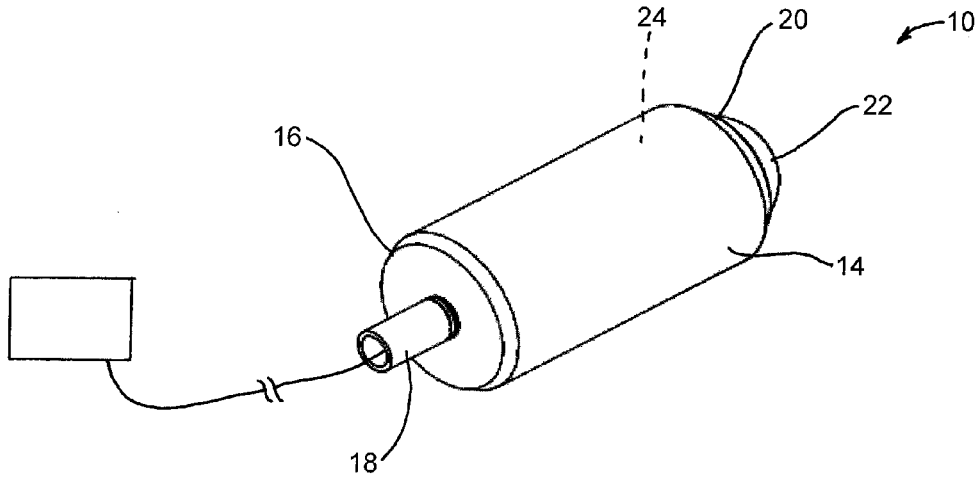
FIG. 1B is a rear isometric view of the lateral connector of FIG. 1A.
Figure 4A:
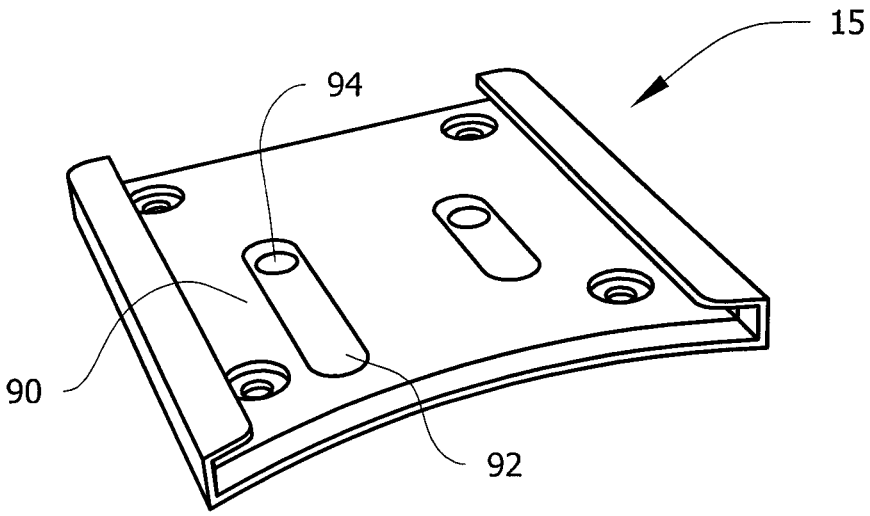
FIG. 4A is an isometric view of a female connector portion, such as a connector plate, with a conductive receiving portion that mates with the lateral connector assembly of FIG. 1A.
Figure 4B:
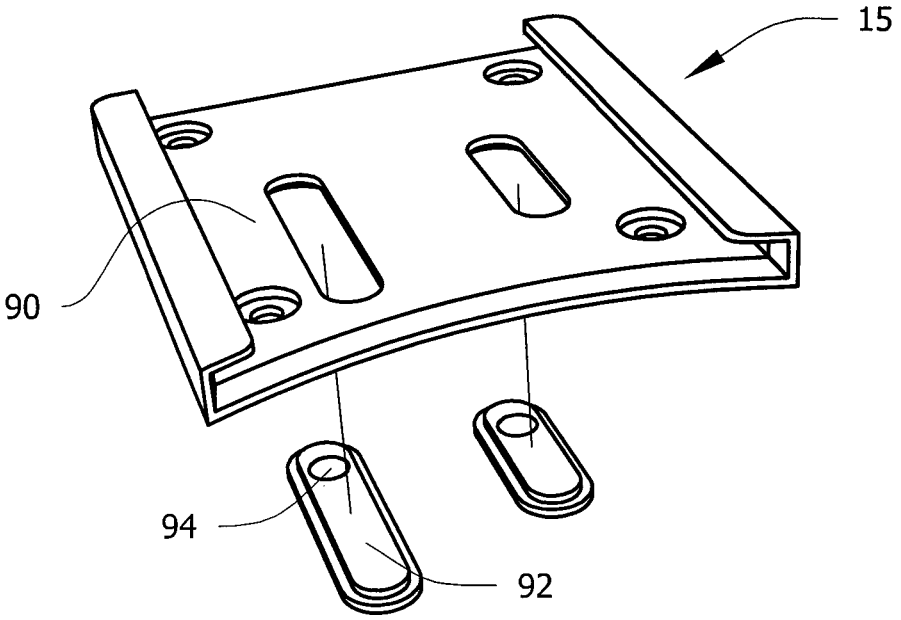
FIG. 4B is a partially exploded isometric view of the connector plate of FIG. 4A.

FIG. 1A is a front isometric view of a ball plunger-style, lateral connector 10 accordance with an embodiment of the present invention, and FIG. 1B is a rear isometric view of the lateral connector. In one embodiment, the lateral connector 10 is an electrically conductive assembly connectable to a power source 12 (shown schematically in FIG. 1B) and configured to provide electrical and mechanical connections to a connector plate 15 (FIGS. 4A and 4B).

Figure 4C:
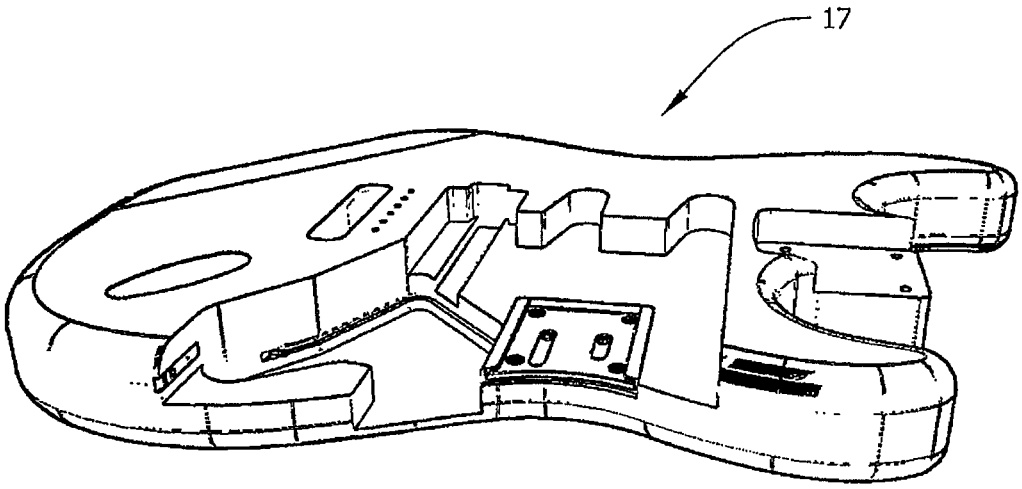
FIG. 4C is an isometric view of the connector plate of FIG. 4A shown positioned in the body of a musical instrument in accordance with an embodiment of the invention.

The lateral connector 10 includes a body 14 that connects at a rear end portion 16 to an electrically conductive pin connector 18 connectable to a wire or other electrically conductive member coupled to the power source 12 (FIG. 1B). The body 14 has an open front portion 20 that retains an electrically conductive ball 22 at least partially within an interior area 24 of the body. The ball 22 is shown in FIGS. 1A and 1B in an extended position wherein the ball 22 at least partially protrudes through the open front portion 20 of the body 14. The body 14 is sized so the ball 22 can be moved into the body's interior area 24 away from the extended position and toward the body's rear end portion 16. As discussed in greater detail below, the ball 22 is biased toward the extended position to enable the lateral connector 10 to operate as a positive, releasable mechanical connector. Further, the ball 22 is electrically coupled to the pin connector 18 so as to conduct electricity from the power source 12 (FIG. 1B) to the connector plate 15 (FIG. 4A-4C). Accordingly, the lateral connector 10 can simultaneously act as a mechanical and electrical connector.

Figure 2A:
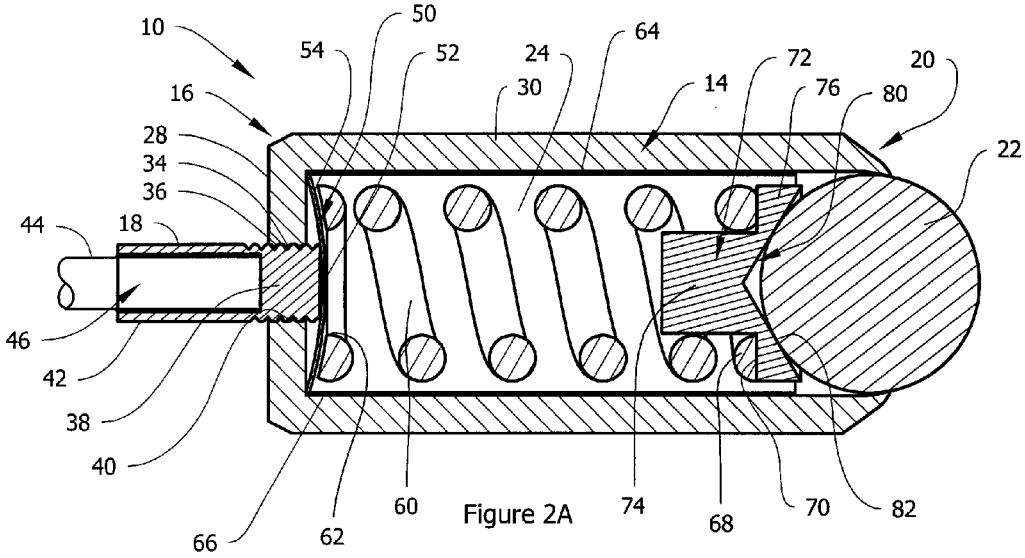
FIG. 2A is an enlarged cross-sectional view of the lateral connector taken substantially along line 2-2 of FIG. 1A, wherein the lateral connector is in an extended position.
Figure 3:
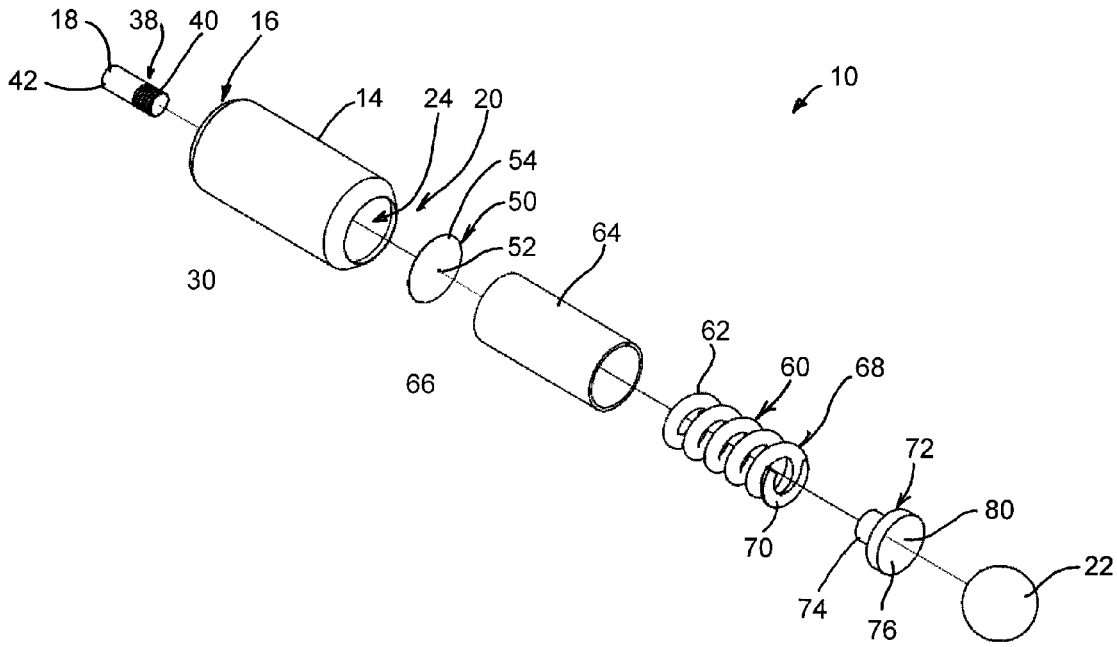
FIG. 3 is an enlarged exploded front isometric view of the lateral connector assembly of FIG. 1A.

FIG. 2A is an enlarged cross-sectional view of the lateral connector 10 taken substantially along line 2A-2A of FIG. 1A, and FIG. 3 is an enlarged exploded front isometric view of the lateral connector 10 of FIG. 1A. In the illustrated embodiment, the body 14 of the lateral connector 10 is a cylindrical body with a closed rear end formed by a rear wall 28 integrally connected to a sidewall 30. The rear wall 28 and the sidewall 30 define the interior area 24 of the body 14.

The lateral connector 10 of the illustrated embodiment is an extremely high performance electrically connector. The electrically conductive body 14 is a machined phosphor bronze body. In other embodiments the body 14 can be made of another selected metal or other electrically conductive material (or combination of materials) suitable for the connector's performance requirements. In the illustrated embodiment, interior surfaces of the body 14 are polished to provide smooth, consistent surfaces for proper engagement with internal components within the interior area 24. The polished interior surfaces help prevent or reduce stray electrical noise within the lateral connector 10 during use.

The rear wall 28 of the body 14 has an aperture 34 therein shaped and sized to receive a portion of the pin 18. In the illustrated embodiment, the aperture 34 is approximately coaxially aligned with the longitudinal axis of the cylindrical body 14. In addition, the aperture 34 includes a plurality of internal threads 36. The pin connector 18 has a threaded engagement end 38 with external threads 40 that mate with the internal threads 36 in the aperture 34. Accordingly, the pin 18 is securely connected to the body 14 by screwing the engagement end 38 of the pin into the rear wall 28 of the body 14. This threaded engagement also provides for a secure and dependable electrical connection between the pin 18 and the body 14. In the illustrated embodiment, the pin 18 is configured with the external threads 40 so that the engagement end 38 of the pin can extend fully through the aperture 34 and project a selected distance past the rear wall 28 into the interior area 24.

The distal end portion 42 of the pin 18, which remains exterior of the body 14, is configured to connect to a wire 44 (FIG. 2A) or other electricity carrier coupled to the power source 12 (FIG. 1B). In the illustrated embodiment, the distal end portion 42 of the pin 18 has a hollow recess 46 that receives the end of the wire 44. The hollow recess 46 is shaped and sized to snugly receive and engage the bare end of the wire 44, while providing enough surface area to contact the wire to establish a reliable electrical connection. In one embodiment, the pin 18 is a gold-plated, hardened copper pin that provides the requisite electrical conductivity properties as well and suitable thermal conductivity properties. The pin 18 in other embodiments can be made of other suitable electrically conductive materials.

The configuration of the pin's distal end portion 42 and the engagement with the wire 44 facilitates a secure and reliable electrical connection by soldering the wire 44 to the pin 18 without damaging the lateral connector 10. In one embodiment, the pin 18 can be soldered to the wire 44 before the pin 18 connected to the body 14. For example, before the pin 18 is screwed into the body's rear wall 28, the wire 44 is positioned into the hollow recess 46 and soldered in place to provide a positive mechanical and electrical connection with the pin. This soldering of the pin 18 to the wire 44 when the pin 18 is detached from the body 14 protects the body and the other internal components of the lateral connector 10 from the heat associated with soldering. Accordingly, the body 14 and the other internal components are protected from heat damage, such as warping, distortion, etc., that could occur if the wire 44 were soldered to the pin 18 when attached to the body 14. Such heat damage could potentially compromise the integrity or performance of the lateral connector 10.

In another embodiment, the lateral connector 10 may be configured for use in selected environments or situations wherein the performance requirements of the assembly allows the pin 18 to be soldered or otherwise securely fixed to the wire 44 when the pin 18 is connected to the body 14. In another embodiment, the lateral connector 10 may be configured for use in selected environments or situations wherein the performance requirements allow the wire 44 to be soldered or otherwise securely fixed directly to the body 14 to obtain the electrical connection between the wire 44 and the body 13 without using the pin 18.

The lateral connector 10 of the illustrated embodiment has an electrically conductive connector plate 50 axially disposed in the interior area 24 of the body 14 immediately adjacent to the rear wall 28 and in electrical contact with the pin 18. In the illustrated embodiment, the connector plate 50 is a gold-plated, copper disc, although other suitably electrically conductive materials can be used in other embodiments. The connector plate 50 has a substantially circular cross-sectional shape with an outer diameter slightly less than the inner diameter of the body. The connector plate 50 fits snugly into the interior area 24, with the perimeter of the connector plate immediately adjacent to and/or in engagement with the sidewall 30 of the body 14. Accordingly, the sidewall 30 of the body 14 prevents or substantially limits lateral movement of the connector plate 50 within the interior area 24.

Although the connector plate 50 of the illustrated embodiment is a circular, disc-shaped member that substantially corresponds to the cross-sectional shape of the body's interior area 24, the connector plate 50 can have different shapers or sizes in other embodiments. For example, the interior area 24 of the body 14 may have a generally circular, elliptical, square, rectangular, polygonal, or other geometric or non-geometric cross-sectional shape, and the connector plate 50 can have a similar cross-sectional shape. In other embodiments the connector plate 50 can have a cross-sectional shape different than the cross-sectional shape of the body's interior area 24, while still maintaining the performance requirements of the lateral connector 10.

As shown in FIG. 2A, the center portion 52 of the illustrated connector portion 50 securely engages the engagement end 38 of the pin 18 to provide a positive electrical connection between these components. In the illustrated embodiment, the center portion 52 of the connector plate 50 is spaced slightly apart from the rear wall 28 of the body 14 because the engagement end 38 of the pin 18 extends past the rear wall and into the body's interior area 24. The connector plate 50 has a partially concave shape (relative to the pin 18 and the rear wall 28), such that a perimeter portion 54 of the connector plate 50 is immediately adjacent to the rear wall 28. In the illustrated embodiment, the perimeter portion 54 of the connector plate engages the rear wall and is positioned substantially within the corner area of the interior area 24 defined by the intersection of the rear wall 28 and the sidewall. 30.

The lateral connector 10 includes an electrically conductive biasing member, shown as a coil spring 60, disposed in the interior area 24 of the body 14. The spring 60 is slightly compressed against the connector plate 50 so the rear end 62 of the spring 60 engages the connector plate's perimeter portion 54. Accordingly, the rear end 62 of the spring 60 holds the connector plate 50 in firm engagement with the engagement end 38 of the pin 18, and the spring 60 holds the connector plate's perimeter portion 54 in firm engagement with the rear wall 28 of the body 14. Accordingly, the spring 60 can help maintain the concave shape of the connector plate 50 relative to the rear wall 28 and the pin 18.

In some embodiments, the coil spring 60 may be susceptible to some buckling within the body when compressed, such that the spring 60 could contact or rub against the body's sidewall 30, which could induce stray electrical noise during use of the lateral connector 10. The lateral connector 10 of the illustrated embodiment is configured to avoid or reduce this stray electrical noise. The lateral connector 10 has an insulator sleeve 64 disposed in the body's interior area 24 immediately adjacent to the sidewall 30, between the spring 60 and the body 14. The insulator sleeve 64 has a bottom edge 66 that also engages the perimeter portion 54 of the connector plate 50. Accordingly, the insulator sleeve 64 works with the spring 60 to securely hold the connector plate 50 in position within the body 14.

In the illustrated embodiment, the insulator sleeve 64 has a high wet dielectric strength with excellent resistance to abrasion, moisture, alkalis, acid, copper corrosion, and varying weather conditions. In one embodiment, the insulator sleeve 64 is a poly vinyl chloride (PVC) tape adhered to the inner surface of the sidewall 30 of the connector body 14. The PVC tape is placed around the interior surface of the body's sidewall 30 to provide a smooth interior surface adjacent to the spring 60. In other embodiments, the insulator sleeve 64 can have other non-tape configurations, such as a non-conductive tubular member press fit into the body 14. While the insulator sleeve 64 of the illustrated embodiment is made of PVC, the insulator sleeve 64 can be made of other non-conductive materials, such as other durable plastic materials with sufficient abrasion resistance at the interface with the spring 60.

As indicated above, the center portion 52 of the connector plate 50 is positioned over the aperture 34 in the rear wall 28. When the pin 18 is screwed into the rear wall 28 (i.e., after being soldered to the wire 44), the pin's engagement end 38 advances into the interior area 24*v* and into engagement with the connector plate 50. As the pin 18 is screwed in further, the engagement end 38 presses the center portion 52 of the connector plate 50 away from the rear wall 28, while the spring 60 and/or the insulator sleeve 64 holds the perimeter portion 54 of the connector plate 50 against the rear wall 28. This configuration allows the connector pin 18 to be used to increase or decrease the concave shape of the connector plate 50.

In one embodiment, the connector pin 18 can be used with the connector plate 50 to adjust the compression and the resulting spring tension of coil spring 60 within the lateral connector 10. This adjustment of the spring 60 can be used to increase or decrease the stiffness of the lateral connector 10 when moving into or out of engagement with the mating connector plate 15 (FIG. 1B). This adjustable stiffness of the lateral connector 10 provides for an adjustable holding strength of the lateral connector 10 to maintain a mechanical engagement with the connector plate 15 (FIG. 1B) or other mating component. The adjustable spring compression also allows for improved engagement and electrical conductance between the components within the lateral connector 10.

The spring compression and the convex shape of the connector plate 50 (relative to the coil spring 60; concave relative to the rear wall 28) also provides for an improved electromechanical junction between the spring 60 and the connector plate 50. For example, the perimeter portion 54 of the connector plate 50 defines a sloped engagement surface that engages the rear end 62 of the spring 60. When the spring 60 is compressed and released during normal operation of the lateral connector 10 (i.e., when the lateral connector 10 is moved between the engaged and disengaged position), the rear end 62 of the spring 60 presses against the connector plate's sloped engagement surface. As the spring 60 presses against this sloped engagement surface, at least the rear end 62 of the spring 60 can undergo a slight increase in its diameter. This radial movement of the spring 60 against the connector plate 50 causes agitation to mating end surfaces of the connector plate 50 and spring 60, thereby improving the electrical conductance between these components over time.

In the embodiments described above, the connector plate 50 is a disc-shaped member that can have a concave/convex shape. In another embodiment, the connector plate 50 can have other shapes and configurations while maintaining the electrical engagement with the spring 60, the pin 18 and/or the body 14. For example, the connector plate 50 can have a partially conical shape, wherein a portion of the connector plate extends partially into the interior of the spring 60. This partially conical shaped connector plate can have a sloped engagement surface against which the rear end 62 of the spring 60 presses. In another embodiment, the connector plate can have a generally flat bottom surface that faces the rear wall 28 of the body 14 and that engages the pin 18. The connector plate 50 may be configured to move axially within the body 14 when the pin 18 is screwed further through the rear wall 28 into the interior area 24, thereby adjusting the spring tension and/or stiffness of the lateral connector 10. The connector plate may also have a threaded aperture in a bottom face into which the threaded engagement end 38 of the pin 18 can be screwed, thereby securely holding the pin 18, the body 14, and the connector plate 50 together as a unit. In other embodiments, the connector plate 50 may have other shapes or configurations that provide the performance requirements for the lateral connector. 10.

In the illustrated embodiment, the electrically conductive spring 60 is a gold-plated, beryllium copper spring. In other embodiments, the spring 60 can be made of another electrically conductive material that provides the desired electric conductivity and mechanical spring properties for the selected performance of the lateral connector 10.

The spring 60 can have fabricated or otherwise shaped ends for optimized conductance between the components within the lateral connector 10. For example, in the illustrated embodiment the rear end 62 of the spring 60 has a flattened surface beveled at an angle to substantially match the convex shaped engagement surface of the connector plate 50 to provide an optimized surface area of the spring's rear end 62 that is in contact with the connector plate 50. In one embodiment, the flattened rear end 62 of the spring 60 and the connector plate 50 may be highly polished surfaces to avoid or substantially reduce oxidation and/or corrosion between the components. This optimized contact surface area provides optimized conductance between the spring 60 and the connector plate 50.

An upper end 68 of the spring 60 is also configured with a flattened engagement surface 70 that mates with an electrically conductive ball track 72. In the illustrated embodiment, the spring's upper end 68 has two-thirds of a flat ground coverage around the circumference of the spring 60 that defines the engagement surface 70. In other embodiments, the spring's upper end 68 can have other shapes or configurations to properly mate with the ball track 72 or other component of the lateral connector 10 to provide a desired and/or optimized conductance between the components. The ball track 72 is positioned within the interior area 24 of the body 14 between the spring 60 and the ball 22 to allow for a smooth rolling action of the ball. If the ball 22 directly engaged the upper end 68 of the spring 60, the ball 22 could bind against the spring 60 and not roll, particularly when the ball 22 is pressed hard against the spring. This binding of the ball 22 to prevent rolling could also result in marring and or otherwise causing excessive wear to the female connector plate 15 (FIG. 4).

In the illustrated embodiment, the ball track 72 has a stem 74 extending rearwardly from a ball cup 76, which sits atop the upper end 68 of the spring 60. The stem 74 and the ball cup 76 are integrally connected to each other forming a unitary member. In other embodiments, the stem 74 may be a separate, non-integral component connected to the ball cup 76. In the illustrated embodiment, the ball track 72 is made of gold plated, hardened copper, although the ball track 72 can be made of a molded synthetic graphite material, or other sufficiently durable, lubricious, conductive materials that will conduct the electricity between the spring 60 and the ball 22 while allowing the ball 22 to roll within the ball cup 76.

The stem 74 of the illustrated ball track 72 is a generally cylindrical portion with an outer diameter slightly greater than the inside diameter within the spring 60 (when the spring is in a relaxed state). When the ball track 72 is assembled with the spring 60, the stem 74 is pushed into the spring's interior area, causing the upper end 68 of the spring 60 to slightly expand radially to receive the stem 74. Accordingly, the upper end 68 of the spring 60 is configured to grab and frictionally hold the stem 74 to maintain a secure juncture between the ball track 72 and the spring 60, while maintaining the required conductance between these electrical conductors.

The ball cup 76 is coaxially aligned with the stem 74 and the spring 60, and the ball cup 76 has a generally flat bottom surface 78 from which the stem projects. The flat bottom surface 78 extends around the stem 72 and forms a generally flat, annular engagement area that securely engages the flattened engagement surface 70 of the spring 60 to provide the mechanical and electrical interconnection between the components while optimizing conductance between these components. In one embodiment, the flat bottom surface 78 and/or the spring's flattened engagement surface 70 can be polished surfaces that help avoid oxidation and/or corrosion between the components.

The ball cup 76 has an outer diameter approximately the same or slightly greater than the outer diameter of the spring 60, so the ball cup sits firmly atop the spring and maintains a substantially perpendicular arrangement relative to the spring. In the illustrated embodiment, the outer edge of the ball cup 76 is immediately adjacent to the top of the insulating sleeve 64 so that the insulating sleeve 64 helps maintain a perpendicular alignment of the ball track 72 as it moves axially within the body's interior area 24 during use of the lateral connector 10. The stem 74 also helps maintain this perpendicular alignment of the ball track 72 on the spring 60 and within the body 60, particularly when the ball track 72 and ball 22 are moved axially within the body 14 during use of the lateral connector 10.

The upper portion of the ball cup 76 includes a concave seating portion 80 that faces toward the open front portion 20 of the body 14 and that defines a rolling surface 82 on the ball track 72 along which the ball 22 can roll during use of the lateral connector 10. The rolling surface 82 and the ball 22 are made of sufficiently lubricious materials so that the friction between the components can be easily overcome to allow the surface of the ball 22 to slide against the rolling surface 82 as the ball 22 rolls within the ball cup 76. In one embodiment, the ball 22 is a gold plated, electro polished, 440 stainless steel ball having a precision grade with high concentricity, hardness rating, and surface finish. This gold plated ball 22 rolls easily against the gold-plated, hardened copper ball cup 76 and provides excellent electrical conductance between the components.

The spring 60 is also balanced with the ball cup 76 and the ball 22, so that the spring 60 will push against the ball cup 76 and keep the seating portion 80 in secure engagement with the ball 22. The spring 60, however, is configured so that it provides a normal force between the ball 22 and the seating portion 80 that is low enough so the ball 22 can still easily roll against the rolling surface 82 during use of the lateral connector 10. If the spring stiffness is too great, the normal force between the ball 22 and the ball cup 76 may be too large so as to create an excessive resistance to the ball 22 rolling within the ball cup 76 during use of the lateral connector 10.

In the illustrated embodiment, the concave seating portion 80 has a generally V-shaped cross-sectional shape so that the ball 22 is constantly in physical contact along an annular contact path that defines the rolling surface 82. In at least one embodiment, the ball 22 and the ball cup 76 are configured so that, over time, the ball 22 can wear into the rolling surface 82 just enough to increase the width of the annular contact path between the ball 22 and the seating portion 80. This wider annular contact path provides for a greater surface area contact between the ball 22 and the ball cup 76. Accordingly, the electrical conductivity performance of the lateral connector 10 can increase over time as the ball 22 and the rolling surface 82 work together to widen the annular contact path. In another embodiment, the ball cup 76 can be machined or otherwise formed with an integral annular contact path with a shallow arcuate channel formed in the rolling surface 82 to create the annular ring into which the ball 22 will sit and roll during use of the lateral connector 10.

While the illustrated embodiment is constructed with a generally V-shaped seating portion 80, other embodiments can have a seating portion 80 with a different cross-sectional shape. For example, the seating portion 80 may have a partially spherical cross-sectional shape with a radius greater than the radius of the ball 22 so the ball will sit in the seating portion 80 and be able to roll against the partially spherical rolling surface. In another embodiment, the concave seating portion 80 can have a partially spherical cross-sectional shape with a radius substantially the same as the radius of the ball 22. In this embodiment, the ball 22 may contact substantially the entire seating portion 80.

As shown in FIG. 2A, when the ball 22 is in an extended position, at least a portion of the ball 22 is positioned within the interior area 24 of the body 14, and another portion of the ball 22 projects through the open front portion 20 of the body 14. In the illustrated embodiment, the open front portion 20 of the body 14 is crimped or otherwise formed to define a mouth having a diameter less than the diameter of the ball 22. Accordingly, less than half of the ball 22 is exterior of the body 14 when the ball is in the extended position. In this extended position, the spring 60 urges the ball 22 toward the extended position, and the crimped open front portion 20 of the body 14 prevents the ball 22 from being fully ejected from the body 14.

Figure 2B:
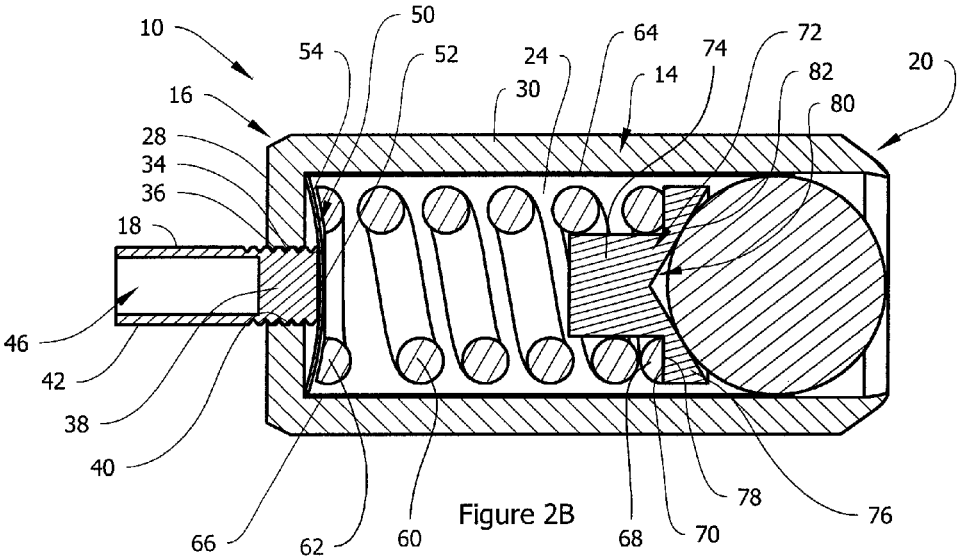
FIG. 2B is an enlarged cross-sectional view of the lateral connector of FIG. 2A shown in a compressed position.

As shown in FIG. 2B, the ball 22 can be moved to a compressed position upon a normal force pushing against the ball 22, which causes the spring 60 to compress within the body 14 so the ball 22 and the ball track 72 move axially and rearwardly into the interior area 24 of the body 14. The ball 22 and ball track 72 are configured so the ball 22 can roll within the ball cup 76 as the ball is being moved between the extended and compressed positions. Further, the electrically conductive ball 22, ball track 72, spring 60, connector plate 50 and the pin 18 all remain in secure physical contact with each other to ensure the electrical conductivity of the lateral connector 10 is always maintained during rolling or axial movement of the ball between the extended and compressed positions.

In the illustrated embodiment, the open front portion 20 of the body 14 is crimped after the ball 22 and other components are assembled within the body 14. In other embodiments, a collar or other retention mechanism may be connected to the open front portion 20 of the body 14 to retain the ball 22 within the body 14 when in the extended position.

The lateral connector 10 of the illustrated embodiment described above provides a high performance connector configured for use within specific electrical and mechanical performance requirements, such as for use with an electric guitar or other musical instrument. The illustrated embodiment provides a laterally actuated connector 10 that has a maximum target resistance of 0.005 KΩ. In addition, the internal components of the lateral connector 10 are provided with polished or otherwise very smooth contact surface, because rough or uneven contact surfaces diminish the ability of the components to maintain an adequate electro-mechanical junction to achieve the performance requirements. Further, rough or uneven contact surfaces can promote oxidation and corrosion, which can diminish the electrical and/or mechanical performance of the lateral connector 10.

Figure 5A:
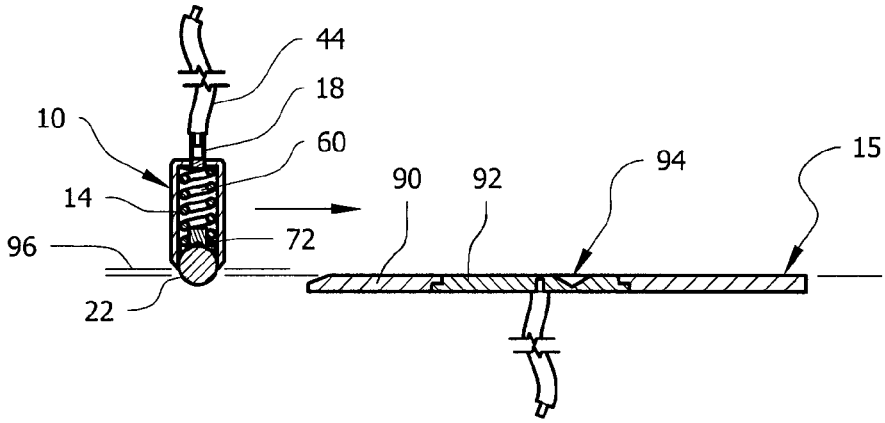
FIG. 5A is a cross-sectional view of the lateral connector of FIG. 2A and the connector portion of FIGS. 4A-4C in a disengaged position during operation of the connector.

The following provides an example of operation of the lateral connector 10 in accordance with an embodiment for purposes of illustration. FIG. 4A is an isometric view of the connector plate 15 with a conductive receiving portion that mates with the lateral connector assembly of FIG. 1A. The connector plate 15 of the illustrated embodiment has two conductive receiving portions, so that the connector plate 15 can simultaneously engage (mechanically and electrically) two lateral connectors. FIG. 4B is a partially exploded isometric view of the connector plate of FIG. 4A with the conductive receiving portions shown relative to a non-conductive plate portion. FIG. 4C is an isometric view of the connector plate 15 of FIG. 4A shown positioned in the body of 17 a musical instrument, such as a guitar body, in accordance with an embodiment of the invention. FIG. 5A is a cross-sectional view of the lateral connector 10 and the connector plate 15 of FIGS. 4A and 4B in a disengaged position during operation. In the illustrated embodiment, the connector plate 15 is a plate used on an electric guitar, such as the type shown in applicant co-pending U.S. patent application Ser. No. 12/508,493 (Publication No. 2010-0031800), titled "Docking System For Pickups On Electric Guitars," and the lateral connector 10 can be connected to the pickup assembly described therein to provide electrical and mechanical connection between the guitar and the pick up assembly. While this example is described in connection with the guitar and pickup assembly, one skilled in the art will recognize that the lateral connector 10 can be used with an electrical connector in other arrangements to provide the electrical and mechanical connection between the desired components.

In this illustrated embodiment, the connector plate 15 is a generally planar alignment guide with a substantially flat engagement portion 90 configured to electrically and mechanically engage the ball 22 of the lateral connector 10. At least a portion of the engagement portion 90 is electrically conductive and is coupled to an electrical component to which electricity is delivered. The engagement portion 90 has a non-conductive plate portion that receives two electrically conductive receiving portions that each define a flat roll-way area 92 along which the ball 22 of the lateral connector 10 can roll, and a concave receiving portion 94 shaped and sized to receive the ball 22 when the lateral connector 10 is in an engaged position with the connector plate 15. In the illustrated embodiment, the concave receiving portion 94 can have a substantially V-shaped cross-sectional shape, a partially spherical shape, or other concave shape that allows the ball 22 to smoothly roll or otherwise and move into and out of the concave receiving portion 94.

During operation, when the lateral connector 10 is in the disengaged position and is to be moved into engagement with the connector plate 15, the lateral connector 10 begins in a position laterally offset from the connector plate 15 and is substantially perpendicular relative to the roll-way portion 92. In the illustrated embodiment (as shown in FIGS. 4A-4C), the connector plate 15 has the two roll-way portions, which are of different lengths. The lengths of the conductive roll-way portions 92 are used to control when the associated lateral connector 10 may first establish electrical engagement between the components when two lateral connectors are simultaneously engaged with the connector plate 15. The open front portion 20 of the body 14 is in a plane 96 that is spaced apart from and substantially parallel with a plane 98 of the surface of the engagement portion 90. Accordingly, the ball 22 extends through the plane 98 of the engagement portion 90 when the lateral connector 10 is in the disengaged position.

Figure 5B:
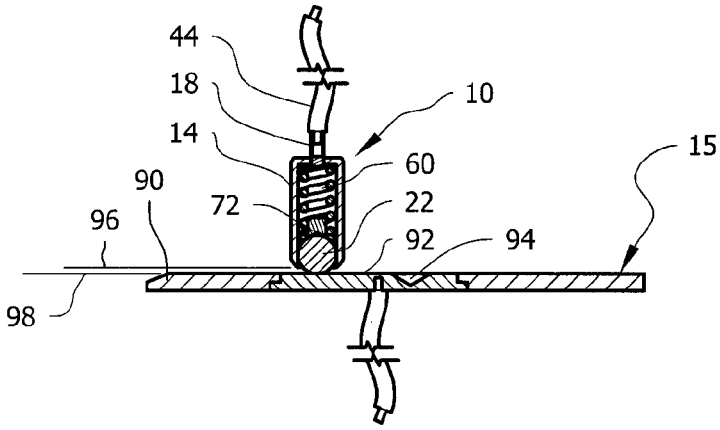
FIG. 5B is a cross-sectional view of the lateral connector of FIG. 2A and the connector portion of FIGS. 4A-4C in an intermediate position during operation of the connector.

As the lateral connector 10 is moved laterally relative to the connector plate 15 toward an intermediate position, shown in FIG. 5B, the ball 22 is moved into engagement with the connector plate 15, such that the connector plate 15 pushes the ball 22 and the ball track 72 axially into the body 14 so as to compress the spring 60 until the ball 22 is in the compressed position, as discussed above. As the lateral connector 10 moved further laterally, the ball 22, in the compressed position, engages and rolls along the flat roll-way area 92 of the engagement portion 90 toward the concave receiving portion 94. During this lateral movement, when the ball 22 is in contact with the roll-way area 92 and/or the concave receiving portion 94, the lateral connector 10 is electrically connected to the connector plate 15.

Figure 5C:
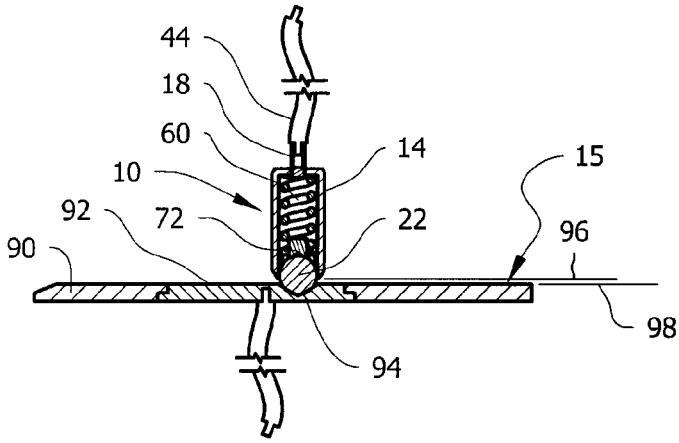
FIG. 5C is a cross-sectional view of the lateral connector of FIG. 2A and the connector portion of FIGS. 4A-4C in an engaged position during operation of the connector.

The lateral connector 10 is moved laterally along the roll-way area 92 until the lateral connector 10 is in the engaged position (shown in FIG. 5C) with the ball 22 coaxially aligned with the concave receiving portion 94. As the lateral connector 10 moves into this engaged position, the ball 22 rolls into alignment with the concave receiving portion 94, and the spring 60 urges the ball track 72 and the ball 22 away from the compressed position toward the extended position so the ball 22 drops into the concave receiving portion 94. When the lateral connector 10 is in this engaged position the ball 22 is firmly seated in the concave receiving portion 94 while maintaining electrical contact therebetween. In addition, the spring 60 firmly holds the ball 22 within the concave receiving portion 94 and resists lateral movement of the lateral connector 10 away from this engaged position. Accordingly, the lateral connector 10 retains the positive mechanical connection with the connector plate 15.

The lateral connector 10 will stay mechanically and electrically engaged with the connector plate 15 until a sufficiently large lateral force is exerted on the lateral connector 10 and/or the connector plate 15 to cause the spring 60 to compress and the ball 22 to roll out of the concave receiving portion 94 and toward the compressed position, so that the lateral connector 10 can moves toward the intermediate position and/or the disengaged position. As indicated above, the spring 60 can be selected and/or adjusted to control the amount of lateral force needed to move the lateral connector 10 out of engagement with the connector plate 15. This configuration provides a ball plunger-style electrical connector that provides for releasable mechanical connection with the connector plate while simultaneously providing an electrical connection with the connector plate suitable for use in, as an example, an electric guitar that requires a reliable, repeatable, precision electrical interface without detracting from the bloodline of the musical instrument.

From the foregoing, it will be appreciated that specific embodiments of the invention have been described herein for purposes of illustration, but that various modifications may be made without deviating from the invention. While embodiments discussed above were configured for use with high impedance, low voltage, low current devices, the lateral connector is not limited to use with such devices, and can be constructed to accommodate lower impedance, higher voltage, and/or higher current devices. Additionally, aspects of the invention described in the context of particular embodiments or examples may be combined or eliminated in other embodiments. Although advantages associated with certain embodiments of the invention have been described in the context of those embodiments, other embodiments may also exhibit such advantages. Additionally, not all embodiments need necessarily exhibit such advantages to fall within the scope of the invention. Accordingly, the invention is not limited except as by the appended claims.

I claim:

1. An electrical connector assembly for engaging and completing electrical contact with a receiving member having a receiving contact portion, comprising:

a pin member operatively couplable to an electricity source, the pin member having first and second end portions and being electrically conductive;

a connector body having a closed end, an open end, a sidewall extending between the closed and open ends, and an interior area, the closed end having an aperture having the pin member therein with the first end portion of the pin member extending at least partially into the interior area;

a connector plate in the interior area of the connector body and positioned adjacent to the closed end of the connector body, the connector plate being electrically conductive and engaging the first end portion of the pin member and providing an electrical connection therebetween;

an insulator sleeve disposed in the interior area of the connector body and adjacent to the sidewall of the connector body;

an electrically conductive biasing member disposed in the interior area of the connector body, the biasing member having a first end portion in engagement with the connector plate, and wherein the insulator sleeve is disposed between the biasing member and the connector body;

an electrically conductive ball track positioned within the interior area of the connector body and in engagement with a second end portion of the biasing member, the ball track having a concave seating portion facing toward the open end of the connector body and defining a rolling surface; and an electrically conductive ball disposed in the open end portion of the connector body and seated in the concave seating portion of the ball track, the ball and ball track being configured to allow the ball to roll relative to the connector body while maintaining engagement with the rolling surface of the ball track, the biasing member urging the ball track into engagement with the ball, the open end of the connector body being sized to retain the ball at least partially within the interior area, and the ball being moveable with the ball track in the interior area toward the closed end of the connector body upon compression of the biasing member, the ball being configured to roll along a portion of the receiving member and to electrically engage the receiving contact portion while maintaining electrical contact with the ball track to achieve electrical interconnection between the pin member and the receiving member.

2. The electrical connector assembly of claim 1 wherein the second end portion of the pin member having a wire-receiving bore configured to operatively receive an electrically conductive wire therein to establish electrical connection with the wire.

3. The electrical connector assembly of claim 1 wherein the first end portion of the pin has threads thereon, and the aperture in the closed end of the connector body is threaded, wherein the first end portion of the pins is screwed into the closed end of the connector body for a secure threaded engagement therebetween.

4. The electrical connector assembly of claim 1 wherein the open end of the connector body has a diameter less than a diameter of the ball and is sized to allow a portion of the ball to project therefrom while preventing more than one-half of the ball from exiting the interior area.

5. The electrical connector assembly of claim 1 wherein the electrically conductive biasing member is compressible to allow the ball and the electrically conductive ball track to move as a unit within the interior area while maintaining electrical connection with the biasing member, the connector plate and the pin member so the ball is substantially fully within the interior area when the ball is moving into electrical connection with the receiving member.

6. The electrical connector assembly of claim 1 wherein the connector body is a substantially cylindrical member axially aligned with the connector plate, the insulator sleeve, the biasing member, the ball track and the ball.

7. The electrical connector assembly of claim 1 wherein the connector plate has a concave-shape that defines a concave area that faces toward the closed end of the connector body, and the first end portion of the pin member extends into the concave area of the connector plate and engages a central portion of the connector plate.

8. The electrical connector assembly of claim 1 wherein the first end portion of the pin member projects past the closed end of the connector body and into the interior area, and at least one of the insulator sleeve and the biasing member presses against the connector plate to retain a perimeter portion of the connector plate adjacent to the closed end of the connector body with the connector plate being retained in a concave shape.

9. The electrical connector assembly of claim 1 wherein the electrically conductive biasing member is a coil spring with a flattened engagement surface engaging a mating portion of the ball track to maintain electrical connection therebetween.

10. The electrical connector assembly of claim 1, wherein the electrically conductive biasing member is a beryllium copper coil spring with fabricated spring ends that maintain electrical connection with the connector plate and the ball track.

11. The electrical connector assembly of claim 10, wherein the coil spring has a first end engaging the ball track and a second end engaging the connector plate.

12. The electrical connector assembly of claim 10, wherein the coil spring has a first end engaging the ball track and a second end engaging the connector plate, the connector plate having a concave shape and a perimeter portion, the second end having a beveled flat portion that mates with the perimeter portion of the connector plate.

13. The electrical connector assembly of claim 1 wherein biasing member is a coil spring with a first end portion and interior space with a generally cylindrical shape, and the electrically conductive ball track has a cup portion that receives the ball and a stem portion extending from the cup portion, the cup portion defining an annular engaging shoulder adjacent to and extending radially outward from the stem portion, the first end portion of the coil spring being in constant engagement with the annular engaging shoulder, and the stem portion is disposed with the interior space of the coil spring adjacent to the first end portion of the coil spring, the stem portion being sized to maintain a friction fit with the first end portion of the coil spring.

14. The electrical connector assembly of claim 13 wherein the ball has a spherical outer surface, and the cup portion has a spherical inner surface that substantially matches the spherical outer surface and is configured to minimize electrical resistance between the spherical inner and outer surfaces and reducing friction therebetween to allow the ball to roll within the cup portion along the spherical inner surface.

15. A ball plunger electrical connector, comprising an electrically conductive connection pin operatively couplable to an electricity source, the pin member having an end portion;

a connector body having one end connected to the pin and having an open end opposite the one end, the connector body having an interior area;

an electrically conductive connector plate in the interior area and in engagement with the end portion of the pin and providing an electrical connection therebetween;

an electrically conductive biasing member disposed in the interior area of the connector body, the biasing member having a first end portion in engagement with the connector plate;

an electrically conductive ball track positioned within the interior area of the connector body and in engagement with a second end portion of the biasing member, the ball track having a cup-shaped seating portion facing toward the open end of the connector body and defining a rolling surface; and an electrically conductive ball disposed in the open end portion of the connector body and seated in the seating portion of the ball track with the ball track being between the ball and the biasing member, the ball and ball track being configured to allow the ball to roll relative to connector body while maintaining engagement with the rolling surface of the ball track, the biasing member urging the ball track into engagement with the ball, and the ball being moveable with the ball track into the interior area of the connector body upon compression of the biasing member.

16. The ball plunger electrical connector of claim 15, further comprising an insulator sleeve disposed in the interior area of the connector body and between the biasing member and a sidewall of the connector body.

17. The ball plunger electrical connector of claim 15 wherein the open end of the connector body had a diameter less than a diameter of the ball, and the connector body is sized to allow less than half of the ball to project through the open end while allowing the ball to move into the interior area upon compression of the biasing member.

18. The ball plunger electrical connector of claim 15 wherein the connector plate has a concave-shape that defines a concave area that faces toward the closed end of the connector body, and the first end portion of the pin member extends into the concave area of the connector plate and engages a central portion of the connector plate.

19. The ball plunger electrical connector of claim 15 wherein the biasing member is a partially compressed coil spring with a flattened engagement surface engaging a mating portion of the ball track to maintain electrical connection therebetween.

20. The ball plunger electrical connector assembly of claim 15 wherein biasing member is a coil spring with a first end portion and interior space with a generally cylindrical shape, and the electrically conductive ball track has a cup portion that receives the ball and a stem portion extending from the cup portion, the cup portion defining an annular engaging shoulder adjacent to and extending radially outward from the stem portion, the first end portion of the coil spring being in constant engagement with the annular engaging shoulder, and the stem portion is disposed with the interior space of the coil spring adjacent to the first end portion of the coil spring, the stem portion being sized to maintain a friction fit with the first end portion of the coil spring.

21. A ball plunger electrical connector for engaging and completing electrical contact with a receiving member having an electrically conductive ball-receiving contact portion, comprising:

an electrically conductive pin operatively couplable to an electricity source, the pin member having first and second end portions and being electrically conductive, the first end being threaded with first threads;

a connector body having a closed end, an open end, a sidewall extending between the closed and open ends, and an interior area, the closed end having a threaded aperture with second threads that mate with the first threads, the pin member being screwed into the threaded aperture with at least a portion of the first end portion of the pin member extending from the closed end and at least partially into the interior area;

an electrically conductive connector plate axially disposed in the interior area of the connector body and positioned adjacent to the closed end of the connector body, the connector plate being electrically conductive and engaging the first end portion of the pin member and providing an electrical connection therebetween, the connector plate having a partially concave shape with a concave portion facing toward the closed end of the connector body with the first end portion of the pin extending into the concave portion;

an insulator sleeve disposed in the interior area of the connector body and adhered to an inner surface of the sidewall of the connector body, the insulator sleeve being configured to prevent electrical stray noise during use of the ball plunger electrical connector; the insulator sleeve having a high wet dielectric strength;

an electrically conductive beryllium copper coil spring disposed in the interior area of the connector body, the spring having an interior space and a first end portion with a beveled flat portion that mates with a perimeter portion of the connector plate, the spring having a second end portion with a flattened engagement surface;

an electrically conductive ball track positioned within the interior area of the connector body and in engagement with a second end portion of the biasing member, the ball track having a cup portion with a concave seating portion facing toward the open end of the connector body and defining a rolling surface, the ball track having a stem portion extending from the cup portion toward the closed end portion of the connector body, the cup portion defining an annular engaging shoulder adjacent to and extending radially outward from the stem portion, the flattened engagement surface of the second end portion of the spring being in constant engagement with the annular engaging shoulder, and the stem portion is disposed within the interior space of the coil spring adjacent to the second end portion of the coil spring, the stem portion being sized to maintain a friction fit with the first end portion of the coil spring;

an electrically conductive ball disposed in the open end portion of the connector body and seated in the concave seating portion of the cup portion of the ball track, the ball and ball track being configured to allow the ball to roll relative to connector body while maintaining engagement with the rolling surface of the ball track, the spring urging the ball track into engagement with the ball, the ball having a first diameter and the open end of the connector body defining a circular opening with a second diameter less than the first diameter, wherein the open end portion of the connector body sized to retain the ball at least partially within the interior area, and the ball being moveable with the ball track in the interior area toward the closed end of the connector body upon compression of the spring, the ball being configured to roll along a portion of the receiving member and to electrically engage the receiving contact portion while maintaining electrical contact with the ball track when any portion of the ball is extending from the connector body to achieve electrical contact with the electrically conductive ball-receiving contact portion.

* * * * *